United States Patent [19]

Ruus

[11] 4,124,227

[45] Nov. 7, 1978

[54] OXIME ETHERS OF MICHLER'S HYDROL, METHOD OF PRODUCING SAME AND PRESSURE-SENSITIVE RECORDING SYSTEMS CONTAINING SUCH COMPOUNDS

[75] Inventor: Henn Ruus, Los Angeles, Calif.

[73] Assignee: Moore Business Forms, Inc., Niagara Falls, N.Y.

[21] Appl. No.: 794,098

[22] Filed: May 5, 1977 (Under 37 CFR 1.47)

[30] Foreign Application Priority Data

May 31, 1976 [BE] Belgium ..... 167467

[51] Int. Cl.[2] ..... B41L 1/36

[52] U.S. Cl. ..... 282/27.5; 260/566 A; 260/566 AE; 427/146; 427/150; 428/307; 428/323; 428/914

[58] Field of Search ..... 427/146, 150; 282/27.5; 428/307, 914; 260/566 AE, 566 A, 295

[56] References Cited

U.S. PATENT DOCUMENTS

| | | | |
|---|---|---|---|
| B 211,786 | 1/1975 | Haddock et al. | 260/566 AE |
| 2,900,388 | 8/1959 | Then | 260/295 |
| 2,915,415 | 12/1959 | Francis et al. | 282/27.5 |
| 3,293,060 | 12/1966 | Harbart | 282/27.5 |
| 3,663,256 | 5/1972 | Miller et al. | 428/914 |
| 4,000,087 | 12/1976 | Maalouf | 428/307 |
| 4,054,718 | 10/1977 | Garner et al. | 428/323 X |

*Primary Examiner*—Thomas J. Herbert, Jr.
*Attorney, Agent, or Firm*—Watson, Cole, Grindle & Watson

[57] ABSTRACT

Disclosed are normally substantially colorless chromogenic oxime ether of Michler's hydrol color precursor compounds having the following generic structural formula:

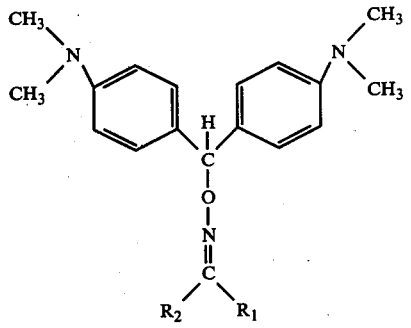

wherein $R_1$ and $R_2$ each represents an organic radical. More specifically, $R_1$ may represent either a lower alkyl group having from one to five carbon atoms or a phenyl group and $R_2$ may represent a substituted or unsubstituted phenyl group having the following formula:

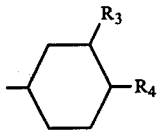

wherein $R_3$ and $R_4$ each separately represents either a hydrogen atom, a chlorine atom or a nitro group. These compounds are initially substantially colorless and are capable of becoming highly colored when brought into reactive contact with many conventional Lewis acid materials or the like. Accordingly, these compounds are highly useful as a component of pressuresensitive copying papers.

9 Claims, No Drawings

OXIME ETHERS OF MICHLER'S HYDROL, METHOD OF PRODUCING SAME AND PRESSURE-SENSITIVE RECORDING SYSTEMS CONTAINING SUCH COMPOUNDS

BACKGROUND OF THE INVENTION

1. Field of the Invention

The present invention relates to initially colorless chromogenic, color precursor compounds having particular utility in the field of carbonless copying. The compounds of the present invention may be utilized, for example, in the production of self-marking impact papers of the transfer or manifolding type wherein a first marking ingredient is carried on one sheet of paper for reaction with a second marking ingredient normally carried on a mating sheet of paper. More particularly, the invention relates to a family of chromogenic oxime ether of Michler's hydrol color precursor compounds having the following structural formula:

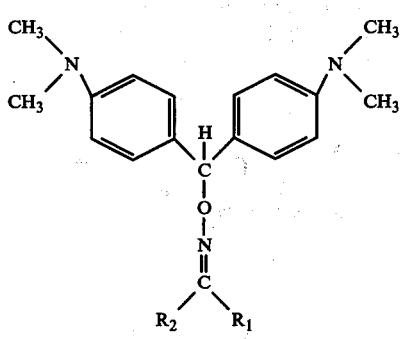

wherein $R_1$ and $R_2$ each represents an organic radical. More preferably, $R_1$ should represent either a lower alkyl group having from 1 to 5 carbon atoms or a phenyl group and wherein $R_2$ should represent a substituted or unsubstituted phenyl group having the following formula:

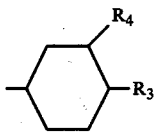

wherein $R_3$ and $R_4$ each separately represents either a hydrogen atom, a chlorine atom or a nitro group.

2. Description of the Prior Art

Impact or pressure sensitive carbonless transfer papers have recently come into wide usage in the United States and throughout the world. Ordinarily, such papers are printed and collated into manifolded sets capable of producing multiple copies. In this connection, pressure applied to the top sheet causes a corresponding mark on each of the other sheets of the manifolded set.

The top sheet of paper, upon which the impact or pressure is immediately applied, ordinarily has its back surface coated with microscopic capsules containing one of the reactive ingredients which produces a mark. A receiver sheet placed in contact with such back face of the top sheet has its front surface coated with a material having a component reactive with the contents of the capsules so that when capsules are ruptured upon impact by stylus or machine key, the initially colorless or substantially colorless contents of the ruptured capsules spill out to react with a coreactant therefor on the receiver sheet and a mark forms on the receiver sheet corresponding to the mark impressed by the stylus or machine key.

In the art, impact transfer papers are designated by the terms CB, CFB and CF, which stand respectively for "coated back", "coated front and back" and "coated front". Thus, the CB sheet is usually the top sheet and the one on which the impact impression is directly made; the CFB sheets are the intermediate sheets, each of which have a mark formed on the front surface thereof and each of which also transmits the contents of ruptured capsules from its back surface to the front of the next succeeding sheet; and the CF sheet is the last sheet and is only coated on its front surface to have an image formed thereon. The CF sheet is not normally coated on its back surface as no further transfer is desired.

While it is customary to coat the capsules on the back surface and to coat the co-reactant for the capsules contents on the front surface of each sheet, this procedure could be reversed if desired. Further, with some systems, coatings need not be used at all and the co-reactive ingredients may be carried in the sheets themselves, or one may be carried in one of the sheets and the other may be carried as a surface coating. Further, the reactants may both comprise microencapsulated liquids. Patents illustrative of many of the various kinds of systems which may incorporate such co-reactive ingredients and which may be used in the production of manifolded transfer papers include, for example, U.S. Pat. Nos. 2,299,694 to Green, 2,712,507 to Green, 3,016,308 to Macaulay, 3,429,827 to Ruus and 3,720,534 to Macaulay et al.

The most common variety of carbonless impact transfer paper, and the type with which the compounds of the present invention are preferably utilized, as the type illustrated, for example, by Green (2,712,507) and Macaulay (3,016,308) wherein microscopic capsules containing a liquid fill comprising a solution of an initially colorless chemically reactive color forming dye precursor are coated on the back surface of the sheet, and a dry coating of a co-reactant chemical for the dye precursor is coated on the front surface of a receiving sheet.

Many color precursors useful in connection with carbonless copying systems are known to those skilled in the art to which the present invention pertains. For example, specific reference is made to the color precursors mentioned in the patent to Phillips, Jr. et al, U.S. Pat. No. 3,455,721 and particularly to those listed in the paragraph bridging columns 5 and 6 thereof. Other color precursors are disclosed in 3,703,397 and 3,713,863 to Lin et al. These color precursor materials are capable of reacting with a CF coating containing an acidic material such as the acid-leached bentonite-type clay disclosed in British Pat. No. 1,381,928, the entirety of which is hereby specifically incorporated by reference, or the acid-reactant organic polymeric material disclosed in the Phillips, Jr. et al 3,455,721 patent. Additional disclosures of acidic coatings which are capable of converting the color precursors into their highly colored form are set forth in U.S. Pat. Nos. 3,622,364, 3,330,722, 3,389,007 and 3,293,060.

The color precursors disclosed in the patents listed above are initially generally colorless and capable of undergoing an acid-base type reaction to become highly colored when brought into contact with an acidic layer such as an acid-leached bentonite-type clay or an acid-reacting polymeric material, or the like. Other previously known color precursors are the spiro-dipyran compounds disclosed in the patent to Harbort, U.S. Pat. No. 3,293,060 with specific reference being made to the disclosure of the 3,293,060 patent extending from column 11, line 32 through column 12, line 21.

Generally speaking, the color precursor materials disclosed above are dissolved in a solvent and the solution is encapsulated in accordance with the procedures and processes described and disclosed by Macaulay (3,016,308) and by Green (3,712,507) as mentioned above. Other processes for encapsulating color precursors are disclosed in U.S. Pat. No. 3,429,827 to Ruus and U.S. Pat. No. 3,578,605 to Baxter. In this connection, it should be mentioned that the exact nature of the capsule itself is not critical as long as the same is capable of containing the color precursor and can be ruptured by the application of pressure in accordance with conventional carbonless copying procedures. Solvents known to be useful in connection with dissolving color precursors include chlorinated biphenyls, vegetable oils (castor oil, coconut oil, cotton seed oil, etc.), esters (dibutyl adipate, dibutyl phthalate, butyl benzyl adipate, benzyl octyl adipate, tricresyl phosphate, trioctyl phosphate, etc.), petroleum derivatives (petroleum spirits, kerosene, mineral oils, etc.), aromatic solvents (benzene, toluene, etc.), silicone oils, or combinations of the foregoing. Particularly useful are the alkylated naphthalene solvents disclosed in U.S. Pat. No. 3,805,463 to Konishi et al.

In the color forming systems outlined above, as will be appreciated by those skilled in the art, the color precursors are conventionally contained in pressure rupturable microcapsules which are included in the back coatings of the sheets of carbonless copying manifolded sets. Further, it will be appreciated that the acidic coatings are generally utilized as front coatings with the color precursor material in a solvent therefor being transferred from an adjacent back coating to the acidic layer front coating upon rupture of the capsules which contain the color precursor material.

SUMMARY OF THE INVENTION

It is an object of this invention to provide new and improved compounds having chromogenic properties and which may be incorporated in a paper sheet or coated onto the surface thereof to provide a manifolding unit, and which are, moreover, useful in carrying out improved methods of marking involving reactive contact with a color-activating material to yield vividly colored reaction products in areas where marking is desired.

It is another object of this invention to provide chromogenic compounds which are substantially colorless or only slightly colored offering a new and improved variety of chromogenic characteristics and yielding novel vividly colored substances upon contact with color-activating materials.

It is a further object of this invention to provide new and improved, normally substantially colorless, chromogenic substances yielding colored reaction products when placed in reactive contact with Lewis acid materials.

The foregoing objects are achieved by the provision of a family of substantially colorless chromogenic oxime ether of Michler's hydrol color precursor compounds having a structural formula as set forth above.

DETAILED DESCRIPTION OF THE PREFERRED EMBODIMENTS

The present invention is directed to a family of normally substantially colorless chromogenic oxime ether of Michler's hydrol color precursor compounds having a structural formula as set forth above. These compounds are initially substantially colorless; however, when brought into contact with a solid Lewis acid electron acceptor material, such as the acid-leached bentonite-type clay disclosed in British Pat. No. 1,381,928, they may be converted into a highly colored form. Various other solid acidic materials which are generally capable of converting these compounds into their highly colored form are disclosed in U.S. Pat. Nos. 3,622,364, 3,330,722, 3,389,007 and 3,293,060 referred to above.

The compounds of the present invention may generally be prepared by reacting Michler's hydrol with an appropriate oxime compound in the presence of an acid in accordance with the following formula:

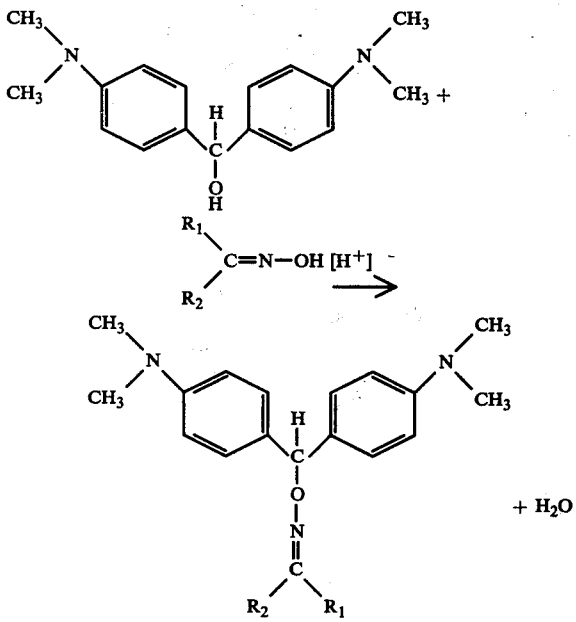

The oxime ethers may generally be prepared by treating an appropriate ketone with hydroxyl amine hydrochloride in the presence of a base, in accordance with the following reaction:

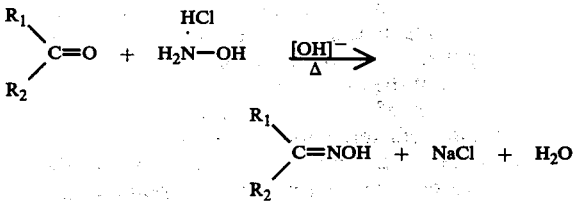

Acetophenone may be used in accordance with the foregoing to produce the acetophenone oxime ether of Michler's hydrol. Likewise, 3-chloroacetophenone, 4-chloroacetophenone, 3-nitroacetophenone, 4-nitroacetophenone and benzophenone may be used to produce the corresponding phenone oxime ethers of Michler's hydrol. In each of the foregoing formulas, $R_1$ and $R_2$ are as described previously.

EXAMPLE 1

30 grams (approximately 0.25 mole) of acetophenone were dissolved in 150 cc of ethyl alcohol in a 500 cc round bottom flask. Then, a solution consisting of 28 grams (approximately 0.4 mole) of hydroxyl amine hydrochloride dissolved in 40 cc of water was added to the flask along with another solution consisting of 28 grams (approximately 0.7 mole) of sodium hydroxide dissolved in 50 cc of water. The resultant admixture was refluxed for approximately 2 hours after which the reaction mixture was poured into a beaker and sufficient ice was added to bring the total volume up to about 1100 cc. Thereafter, while the reaction mixture was stirred, concentrated hydrochloric acid was added dropwise to lower the pH of the reaction mixture to approximately 4–5. The acetophenone oxime precipitate was then removed by filtration and was washed with copious quantities of distilled water to remove any unreacted hydroxyl amine hydrochloride and any inorganic salts which may have been present. The total yield was 30 grams (90% of theoretical) of a product having a melting point of 52°–53° C.

15 grams (approximately 0.055 mole) of recrystallized Michler's hydrol was then added to a beaker and dissolved in 60 cc of acetone. The beaker was warmed slightly during this operation to hasten the dissolution of the Michler's hydrol. Thereafter, 7.3 grams (approximately 0.055 mole) of the acetophenone oxime produced above were introduced into the beaker. Subsequently, 0.5 N hydrochloric acid catalyst was added dropwise (approximately 10 drops) until the solution turned blue. The reaction mixture was then cooled in a freezer for several hours and the solid precipitate was removed by filtration. This precipitate was washed and dried to present 7.5 grams of crude product having a melting point of 124.5°–126.5° C.

The volume of the filtrate was then reduced by one-third and the same was then cooled again in the freezer for several hours. Again the precipitate was removed by filtration presenting another 10.0 grams of crude product having a melting point of 125.5°–128° C. The two quantities of product (total of 17.5 grams) were combined and recrystallized from a mixture of 50 cc benzene and 200 cc of high boiling petroleum ether. After filtration, washing and drying, 15.0 grams of product having a melting point of 127°–128° C. were obtained. This product had the following structural formula:

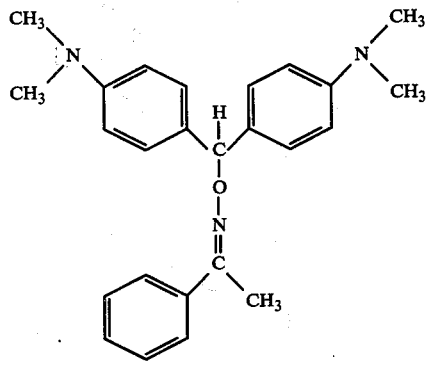

EXAMPLE 2

7.7 grams (approximately 0.05 mole) of 3-chloroacetophenone were dissolved in 10 cc of ethyl alcohol in a 100 cc beaker. Thereafter, a solution consisting of 5 grams of hydroxyl amine hydrochloride dissolved in 10 cc of water was added to the beaker. Another solution consisting of 3.8 grams of sodium carbonate dissolved in 10 cc of water was then added to the beaker over a period of approximately 15 to 20 minutes while the mixture in the beaker was stirred. Stirring was continued for an additional 25 to 30 minutes and the beaker containing the reaction mixture was then placed in a refrigerator for crystallization. The solid precipitate was removed by filtration and after washing and drying, 6.1 grams of crude product having a melting point of 65°–88° C. was recovered.

The filtrate was boiled down to one-half its volume and the same was again cooled in a refrigerator to crystallize additional product. The solid precipitate removed by filtration comprised 2.1 grams of additional crude product. The 2 batches of crude product (total of 8.2 grams) were combined and dissolved in 40 cc of low boiling ligroin at boiling conditions. This solution was then refrigerated to recrystallize the product. After filtration, washing and drying, 6.5 grams of a 3-chloroacetophenone oxime product having a melting point of 87°–89° C. were obtained.

8.0 grams (approximately 0.03 mole) of Michler's hydrol and 5.1 grams (approximately 0.03 mole) of the 3-chloroacetophenone oxime obtained above, were introduced into a 100 cc round bottom flask. 50 cc of lacolene and 3 drops of 0.5 N hydrochloric acid catalyst were added to the flask. The solution in the flask was then refluxed for 1½ hours. The reaction mixture was cooled and the solid product obtained was removed by filtration. After washing with 30 cc of alkaline ethyl alcohol and drying, 11.0 grams of a crude product having a melting point of 106°–110° C. were obtained. The 11.0 grams of crude product were added to 110 cc of alkaline methanol and the mixture was boiled for a short period of time. This mixture was then cooled to room temperature and the white solid product was removed by filtration. 8.8 grams of 3'-chloroacetophenone oxime ether of Michler's hydrol having a melting point of 107.5° to 110° C. were thus obtained. This product had the following structural formula:

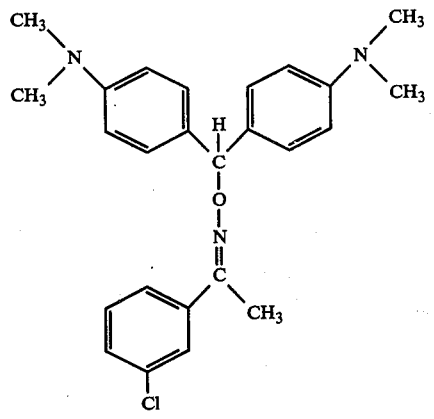

EXAMPLE 3

15.5 grams (approximately 0.1 mole) of 4-chloroacetophenone were dissolved in 50 cc of ethyl alcohol in a 250 cc beaker. Thereafter, a solution consisting of 15 grams (0.214 mole) of hydroxyl amine hydrochloride dissolved in 30 cc of water were added to the beaker. Then, another solution consisting of 10 grams (0.25 mole) of sodium hydroxide dissolved in 30 cc of water were added to the beaker and the resultant solution was heated for 10 minutes on a hot plate. The reaction mixture was cooled to room temperature and poured into another beaker containing about 250 cc of cold water. The resultant mixture was acidified to a pH of 3 to 5 with strong hydrochloric acid to dissolve any unreacted hydroxyl amine. The white solid product was removed by filtration and after washing and drying, 15.6 grams of crude 4-chloroacetophenone oxime product were obtained.

The crude product was introduced into a beaker and was recrystallized from a solution comprising 80 cc of low boiling ligroin and 20 cc of high boiling ligroin. After filtration, washing and drying, 14.1 grams of a 4-chloroacetophenone oxime product having a melting point of 95°–98° C. was obtained.

10 grams (approximately 0.037 mole) of Michler's hydrol and 6.3 grams (approximately 0.037 mole) of the 4-chloroacetophenone oxime product obtained above were introduced into a 100 cc beaker. 50 cc of acetone and 7 drops of 0.5 N hydrochloric acid as a catalyst were added to the beaker and the mixture was warmed slightly. The reaction mixture was then refrigerated for several hours to precipitate product. The precipitate was removed by filtration and after washing with 40 cc of alkaline ethanol and drying, 12.5 grams of a crude product having a melting point of 140°–163° C. was obtained.

The 12.5 grams of crude product thus obtained were treated with 125 cc of alkaline ethanol and the resultant solution was boiled and filtered hot. Both the insoluble material and the filtrate were saved for recrystallization. The total yield was 10.7 grams of product. The ethanol insoluble product had a melting point of 160°–162.5° C. while the ethanol soluble portion had a melting point of 159.5°–162° C.

The 10.7 grams of product obtained was added to a solvent comprising 160 cc of alkaline ethanol and 95 cc of benzene. The admixture was then boiled until most of the product had dissolved. This solution was then decanted while hot and recrystallization was caused to occur to produce 8.6 grams of 4'-chloroacetophenone oxime ether of Michler's hydrol having a melting point of 160.5°–164.5° C. This product had the following structural formula:

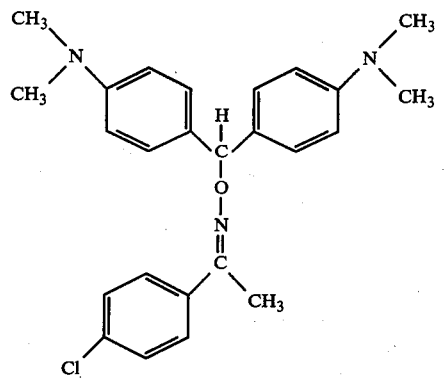

EXAMPLE 4

In this example, 16.5 grams (approximately 0.1 mole) of 3-nitroacetophenone was dissolved in 100 cc of ethanol in a beaker. Thereafter, a solution consisting of 11.9 grams (approximately 0.17 mole) of hydroxyl amine hydrochloride dissolved in 20 cc of water was also introduced into the beaker. Then, another solution consisting of 12 grams (0.2 mole) of potassium hydroxide dissolved in 20 cc of water was added to the reaction mixture. The resultant admixture was stirred for 30 minutes and then 200 cc of cold water were added. The reaction mixture was then acidified to a pH of 3–5 with strong hydrochloric acid and the solid product was removed by filtration. After washing and drying, 26.0 grams of crude product were obtained. The crude product was crystallized from a mixture of 200 cc benzene and 100 cc high boiling ligroin to present a total yield of 5.8 grams of 3-nitroacetophenone oxime having a sublimation point of 112°–125° C.

7.5 grams (approximately 0.0278 mole) of Michler's hydrol and 5.0 grams (approximately 0.0278 mole) of the 3-nitroacetophenone oxime thus produced were introduced into a 100 cc beaker. 40 cc of acetone and 20 drops of 0.5 N hydrochloric acid catalyst were added to the beaker and the reaction mixture was warmed slightly until all of the material was dissolved. The resultant solution was cooled in a refrigerator and the yellow precipitate was removed by filtration. After washing twice with 20 cc of alkaline methanol and drying, 6.5 grams of 3'-nitroacetophenone oxime ether of Michler's hydrol having a melting point of 142° to 149° C. were obtained. This product had the following structural formula:

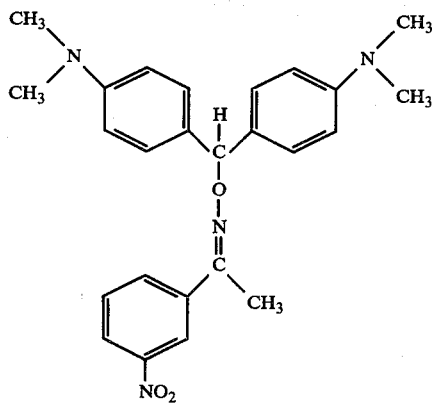

EXAMPLE 5

16.5 grams (0.1 mole) of 4-nitroacetophenone were dissolved in 100 cc of ethanol in a 250 cc beaker. Then, a solution consisting of 11.9 grams (0.17 mole) of hydroxyl amine hydrochloride dissolved in 20 cc of water was also introduced into the beaker. Another solution consisting of 15 grams of sodium carbonate dissolved in 50 cc of water was then added and the resultant mixture was stirred for 30 minutes. After stirring, the reaction mixture was acidified with strong hydrochloric acid and the resultant solid product was removed by filtration. 15.3 grams (85% yield) of a 4-nitroacetophenone oxime product having a sublimation temperature of 140°-157° C. was obtained.

7.5 grams (approximately 0.0278 mole) of Michler's hydrol and 5.0 grams (approximately 0.0278 mole) of the 4-nitroacetophenone oxime thus produced were introduced into another beaker. Thereafter, 40 cc of acetone and 25 drops of 0.5 N hydrochloric acid catalyst were added to the reaction mixture which was then warmed slightly until all of the materials dissolved. The reaction mixture was cooled in a refrigerator and the precipitated solids were removed by filtration. The volume of the filtrate was reduced by ½ to obtain a second crop of product. The total yield of yellow solid product was 9.6 grams.

8.7 grams of the yellow solid product were dissolved in a boiling mixture comprising 85 cc of benzene and 45 cc of high boiling ligroin. The solution was then cooled to recrystallize the product which was removed by filtration, washed and dried. 7.3 grams of 4'-nitroacetophenone oxime ether of Michler's hydrol having a melting point of 174°-177° C. were thus obtained. The structural formula of this material was as follows:

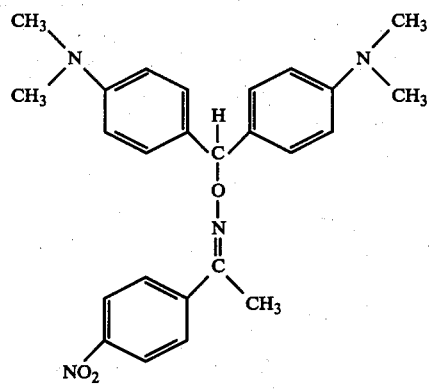

EXAMPLE 6

20 grams (approximately 0.11 mole) of benzophenone were dissolved in 260 cc of ethyl alcohol and the resultant solution was introduced into a 1 liter round bottom flask. Thereafter, a solution consisting of 24 grams (approximatly 0.35 mole) of hydroxyl amine hydrochloride dissolved in 160 cc of water was added to the flask. Another solution consisting of 40 grams of sodium hydroxide dissolved in 60 cc of water was cautiously added to the flask and the reaction mixture was brought to a boil and refluxed for about 1 hour. The reaction mixture was cooled and approximately 1 liter of cold water was added thereto. This dilute mixture was then slowly acidified to a pH of about 3-5 using strong hydrochloric acid. The solid product was removed by filtration, washed with water and dried. The yield was 21.0 grams (approximately 97% of theoretical) of benzophenone oxime having a sublimation temperature of 110°-140° C. and a melting point of approximately 142° C.

9.4 grams (approximately 0.035 mole) of Michler's hydrol and 6.9 grams (approximately 0.035 mole) of the benzophenone oxime thus produced were introduced into a beaker. Thereafter, 40 cc of acetone and 15 drops of 0.5 N hydrochloric acid were added to the mixture which was warmed slightly to insure complete dissolution of all the ingredients. The resultant solution was cooled in a refrigerator and the precipitate thus produced was removed by filtration. The total yield was 11.1 grams of crude product.

9.7 grams of the crude product were purified by admixing the same with 100 cc of ethanol and heating the admixture to boiling while stirring. The resultant admixture was filtered hot and the solids were washed with 30 cc of hot alkaline ethanol. A second crop of product was then recrystallized from the filtrate. The ethanol insoluble product had a melting point of 140°-146° C. and the ethanol soluble material also had a melting point of 140°-146° C. The total yield was 9.4 grams.

The 9.4 grams of product was added to 100 cc of alkaline methanol which was then heated to a boil and 50 cc of benzene were added to dissolve most of the solids present. The resultant mixture was filtered hot and the volume of the filtrate was reduced by 2/3. The filtrate was then cooled to recrystallize the product. The yield at this point was 7.1 grams of a material having a melting point of 141°-145° C.

The 7.1 grams of product recovered were then added to 105 cc of methanol and 37 cc of benzene. This admixture was heated to boiling until all of the solid materials had dissolved. The resultant solution was then cooled to recrystallize 4.9 grams of benzophenone oxime ether of Michler's hydrol having a melting point of 133.5°-135.5° C. This product had the following structural formula:

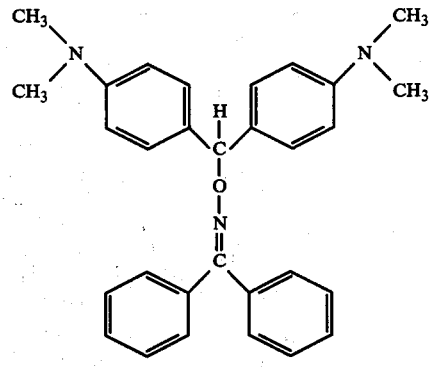

EXAMPLE VII 1.00 gm of the acetophenone oxime ether of Michler's hydrol produced in accordance with EXAMPLE I was admixed with 20.0 grams of R-300 solvent (a commercial product of Kureha Corporation of America which is a mixture of alkylated naphthalenes and is apparently generally disclosed in U.S. Pat. No. 3,806,463 to Konishi et al.) and this admixture was warmed slightly on a hot plate until a clear solution (solution A) was obtained. Thereafter solution A was allowed to cool to room temperature. (When a small quantity of solution A was applied to an acid-leached clay coating on a paper substrate, a vivid color appeared). Then, 3.26 gms of terephthaloyl chloride were added to 10.0 gms of R-300 solvent and this mixture was also warmed slightly on a hot plate until a clear solution (solution B) was obtained. Solution B was then allowed to cool to room temperature. After solutions A and B were prepared, 100 gms of an aqueous solution containing 2.0 weight percent Elvanol 50–42 (a commercial product of E. I. duPont de Nemours which is a polyvinyl alcohol with 87 to 89% hydrolysis and a viscosity of 35 to 45 cps in a 4% aqueous solution at 20° C.) were placed in a semi-micro Waring blender and then solutions A and B were mixed together at room temperature and the resultant solution was added to the Elvanol solution in the blender. The blender was activated and high shear agitation was continued for about two minutes until an emulsion having a dispersed phase particle size of about 2 to 10 microns was obtained. In this emulsion, the aqueous solution containing the Elvanol polyvinyl alcohol formed the continuous phase and the solution containing the R-300 solvent, the acetophenone oxime ether of Michler's hydrol and terephthaloyl chloride formed the dispersed phase. The emulsion was then transferred to a suitable container such as a beaker and was stirred with a variable speed mechanical stirrer at 300 to 500 rpm while an aqueous solution containing 1.86 gms of diethylene triamine, 1.20 gms of sodium carbonate and 20 ml of water was added. Stirring was continued at room temperature for about 24 hours until a stable pH of about 8.0 was observed. At this time, the particles of dispersed phase had become individually encapsulated in a polyamide shell. The slurry containing the microcapsules and having the Elvanol polyvinyl alcohol binder in the continuous phase was then drawn down on a 13 pound neutral base continuous bond paper sheet at a coating weight of approximately 2.34 to 3.04 gms per square meter and the coated sheet was oven dried at a temperature of 110° C. for about 30 to 45 seconds. The dry coating of microcapsules containing the acetophenone oxime ether of Michler's hydrol was then brought into contact with an acid-leached clay coating on the surface of another sheet of paper and when an impression was made on the reverse side of the sheet coated with microcapsules a corresponding colored reproduction of such impression appeared on the acid-leached clay coating within approximately 30 seconds.

EXAMPLE VIII

In this Example, the procedures and quantities of materials were identical with EXAMPLE VII, except that in this instance, dibutyl phthalate was utilized as the solvent for the dispersed phase (solutions A and B) rather than R-300. The results were similar with those obtained in EXAMPLE VII.

Other solvents for color precursors are known to those skilled in the art to which this invention pertains and any solvent which does not substantially interfere with the formulation of color when the color precursor is contacted with a co-reactant may be utilized.

EXAMPLE IX

In this Example, the procedure and quantities of the materials were identical with EXAMPLE VIII except that in this instance 2.0 grams of EPON 1002 (a product of Shell Chemical Co.) were included in solution A. The EPON was added to the dibutyl phthalate before the acetophenone oxime ether of Michler's hydrol was dissolved therein. EPON 1002 and the purposes for including the same in the dispersed phase are fully described and discussed in application Ser. No. 493,966 filed July 29, 1974.

It is to be noted that the compounds of the present invention are useful generally in the production and generation of colored marks and it is not critical to the present invention that the same be utilized in a copying system or in a micro-encapsulated form.

I claim:

1. In a pressure-sensitive recording system comprising a substantially colorless color precursor compound and a layer of an electron-acceptor material, the improvement which comprises utilizing acetophenone oxime ether of Michler's hydrol as said color precursor compound.

2. In a pressure-sensitive recording system comprising a layer containing a substantially colorless color precursor compound and a layer of an electron-acceptor material, the improvement which comprises utilizing acetophenone oxime ether of Michler's hydrol as said color precursor compound.

3. In a pressure-sensitive recording system comprising a layer of microcapsules containing a substantially colorless color precursor compound and a layer of an electron-acceptor material, the improvement which comprises utilizing acetophenone oxime ether of Michler's hydrol as said color precursor compound.

4. In a pressure-sensitive recording system comprising a substantially colorless precursor compound and a layer of an electron-acceptor material, the improvement which comprises utilizing, as said color precursor compound, a substantially colorless oxime ether of Michler's hydrol dye precursor compound having the following structural formula:

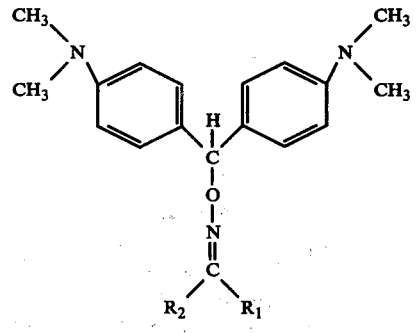

wherein $R_2$ and $R_1$ each represents an organic radical.

5. In a pressure-sensitive recording system comprising a layer containing a substantially colorless color precursor compound and a layer of an electron-acceptor material, the improvement which comprises utilizing, as said color precursor compound, a substantially colorless oxime ether of Michler's hydrol dye precursor compound having the following structural formula:

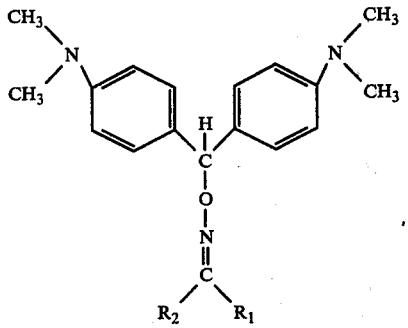

wherein $R_2$ and $R_1$ each represents an organic radical.

6. In a pressure-sensitive recording system comprising a layer of microcapsules containing a substantially colorless precursor compound and a layer of an electron-acceptor material, the improvement which comprises utilizing, as said color precursor compound, a substantially colorless oxime ether of Michler's hydrol dye precursor compound having the following structural formula:

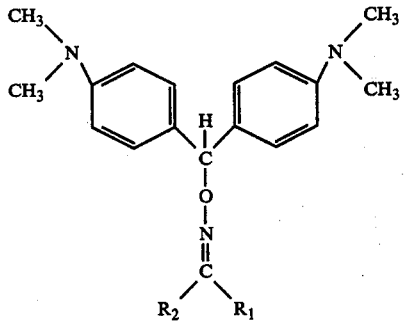

wherein $R_2$ and $R_1$ each represents an organic radical.

7. In a pressure-sensitive recording system comprising a substantially colorless color precursor compound and a layer of an electron-acceptor material, the improvement which comprises utilizing, as said color precursor compound, a phenone oxime ether of Michler's hydrol having the following structural formula:

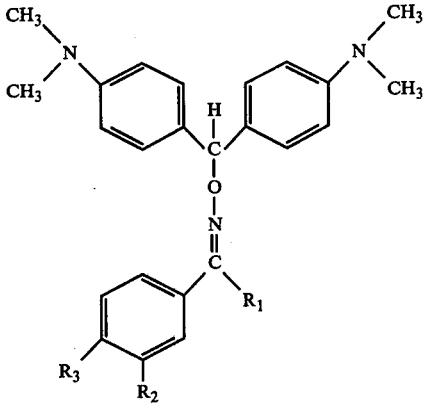

wherein $R_1$ represents either a lower alkyl group having from one to five carbon atoms or a phenyl group and wherein $R_2$ and $R_3$ each separately represent either a hydrogen atom, a chlorine atom or a nitro group.

8. In a pressure-sensitive recording system comprising a layer containing a substantially colorless color precursor compound and a layer of an electron-acceptor material, the improvement which comprises utilizing, as said color precursor compound, a phenone oxime ether of Michler's hydrol having the following structural formula:

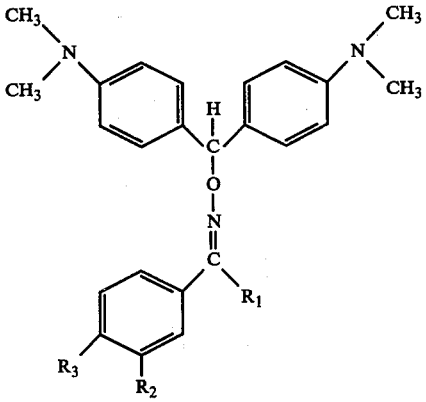

wherein $R_1$ represents either a lower alkyl group having from one to five carbon atoms or a phenyl group and wherein $R_2$ and $R_3$ each separately represent either a hydrogen atom, a chlorine atom or a nitro group.

9. In a pressure-sensitive recording system comprising a layer of microcapsules containing a substantially colorless color precursor compound and a layer of an electron-acceptor material, the improvement which comprises utilizing, as said color precursor compound, a phenone oxime ether of Michler's hydrol having the following structural formula:

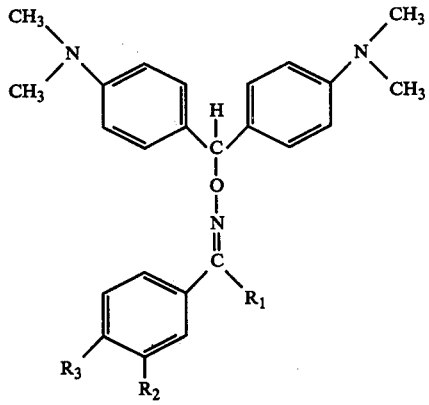

wherein $R_1$ represents either a lower alkyl group having from one to five carbon atoms or a phenyl group and wherein $R_2$ and $R_3$ each separately represent either a hydrogen atom, a chlorine atom or a nitro group.

* * * * *